US006786205B2

(12) United States Patent
Stuhldreher et al.

(10) Patent No.: US 6,786,205 B2
(45) Date of Patent: Sep. 7, 2004

(54) HYDRAULICALLY INTENSIFIED HIGH PRESSURE FUEL SYSTEM FOR COMMON RAIL APPLICATION

(75) Inventors: Mark Spencer Stuhldreher, Pinckney, MI (US); Andrew James Moskalik, Detroit, MI (US)

(73) Assignee: The United States of America as represented by the Environmental Production Agency, Washington, DC (US)

( * ) Notice: Subject to any disclaimer, the term of this patent is extended or adjusted under 35 U.S.C. 154(b) by 53 days.

(21) Appl. No.: 10/337,587

(22) Filed: Jan. 8, 2003

(65) Prior Publication Data

US 2004/0129255 A1 Jul. 8, 2004

(51) Int. Cl.[7] ..... F02M 33/04

(52) U.S. Cl. ..... 123/495; 123/456; 123/446; 123/447

(58) Field of Search ..... 417/225, 226; 123/495, 446, 447, 456

(56) References Cited

U.S. PATENT DOCUMENTS 4,383,418 A * 5/1983 Holzer ..... 62/235.1
4,494,676 A * 1/1985 Berweger ..... 222/63
4,599,861 A * 7/1986 Beaumont ..... 60/595
5,884,597 A * 3/1999 Hiraku et al. ..... 123/179.17
2002/0023598 A1 * 2/2002 Valentin ..... 123/46 R

* cited by examiner

*Primary Examiner*—Thomas N. Moulis
(74) *Attorney, Agent, or Firm*—Lorusso. Loud & Kelly

(57) ABSTRACT

A common rail intensifier fuel injection system includes a plurality of fuel injectors respectively associated with cylinders of an internal combustion engine. A common rail supplies fuel at an intensified pressure to the fuel injectors and receives the fuel at the intensified pressure, alternately, from at least two fuel pressure intensifying circuits. At least one of the fuel pressure intensifying circuits includes a fuel pressure intensifier having an operating chamber for receiving and discharging an operating fluid, and a fuel chamber of a diameter smaller than that of the operating chamber for receiving fuel at a low pressure from the fuel supply and discharging the fuel at the intensified pressure into one of the fuel pressure intensifying circuits. A control valve, in a first position, connects the operating fluid source with the operating chamber of the fuel pressure intensifier and, in a second position, connects the operating chamber of the fuel pressure intensifier with a drain. A controller switches the control valve between the first and second positions and switches the supply of fuel at the intensified pressure, to the common rail, between the various fuel pressure intensifying circuits.

5 Claims, 1 Drawing Sheet

HYDRAULICALLY INTENSIFIED HIGH PRESSURE FUEL SYSTEM FOR COMMON RAIL APPLICATION

FIELD OF THE INVENTION

This invention relates to high pressure common rail fuel injection systems. Currently, such systems are used in engine testing. This invention also contemplates installation in a vehicle to provide a more clean burning engine.

THE PRIOR ART

Currently, the automotive industry does not have a reliable high pressure fuel system which is compatible with alcohol fuels.

Mechanically driven high pressure piston fuel pumps are typically used for high pressure diesel fuel injection systems. These type pump systems require lubrication of the moving parts by the fuel. Alcohol fuels, in comparison to diesel, have very low lubricity and reliance on an alcohol fuel for lubrication will result in premature wear of the internal pump components. Further, these pumps are expensive due to the requirement for high precision of internal pumping components.

In conventional hydraulically intensified fuel injectors, low pressure fuel enters the injector and is intensified in pressure by a hydraulic piston. The injector and intensifier are contained in a single unit, which requires separate hydraulic and fuel supplies. The disadvantage of such a fuel system is the large number of moving parts, since each injector has an intensifier piston assembly. There are also individual hydraulic lines and fittings for each injector. The large number of moving parts and individual lines increases the expense of the fuel injection system, decreases durability and the useful life, and increases the possibility of leakage.

SUMMARY OF THE INVENTION

The present invention separates the intensifier from the injector and provides a structure having fewer parts to wear and fewer hydraulic lines to potentially leak. The system has at least two intensifier units which use hydraulic fluid to pressurize fuel supplied to a common rail. These intensifiers alternately supply high pressure fuel to the common rail and refill with low pressure fuel.

Accordingly, the present invention provides a common rail intensifier fuel injection system for a multi-cylinder internal combustion engine with multiple cylinders. The fuel injection system of the present invention includes a plurality of fuel injectors respectively associated with the multiple cylinders and a common rail for supply of fuel at an intensified pressure to the plural fuel injectors. The fuel injection system further includes a fuel supply containing fuel at a low pressure, relative to the intensified pressure within the common rail, and at least two pressure intensifying circuits for alternately supply fuel at the intensified pressure to the common rail. The system further includes a source of an operating fluid which can either be hydraulic fluid or air (pneumatic). At least one of the fuel pressure intensifying circuits includes a fuel pressure intensifier having an operating chamber of a first diameter for receiving and discharging the operating fluid. The fuel pressure intensifier also has a fuel chamber of a second diameter, smaller than the first diameter, for receiving fuel at the low pressure from the fuel supply and discharging fuel at the intensified pressure to its associated fuel pressure intensifying circuit.

In a preferred embodiment a double piston extends between the two chambers of the intensifier with a first piston head in the operating chamber and a second piston head in the fuel chamber. The system further includes at least a first control valve for, in a first position, connecting the operating fluid source with the operating chamber of the fuel pressure intensifier and, in a second position, connecting the operating chamber of the fuel pressure intensifier with a drain. A controller or "control means" is included for switching the control valve between the first and second positions and for switching the supply of fuel at the intensified pressure to the common rail between the plural fuel pressure intensifying circuits.

In one preferred embodiment the fuel injection system described above further includes an accumulator for storing fuel at the intensified pressure and a second control valve switched between at least two positions by the control means, connecting the accumulator with the common rail in one position and connecting the accumulator with the fuel pressure intensifier in another position.

In another preferred embodiment the fuel injector system of the present invention includes another fuel pressure intensifier, as described above, which provides fuel at the intensified pressure to a second fuel pressure intensifying circuit.

The fuel injection system of the present invention offers the advantage of providing the high pressure supply for a methanol fuel, which system is compatible with a hydraulic pressure power source.

DESCRIPTION OF THE PREFERRED EMBODIMENTS

Figure 1:
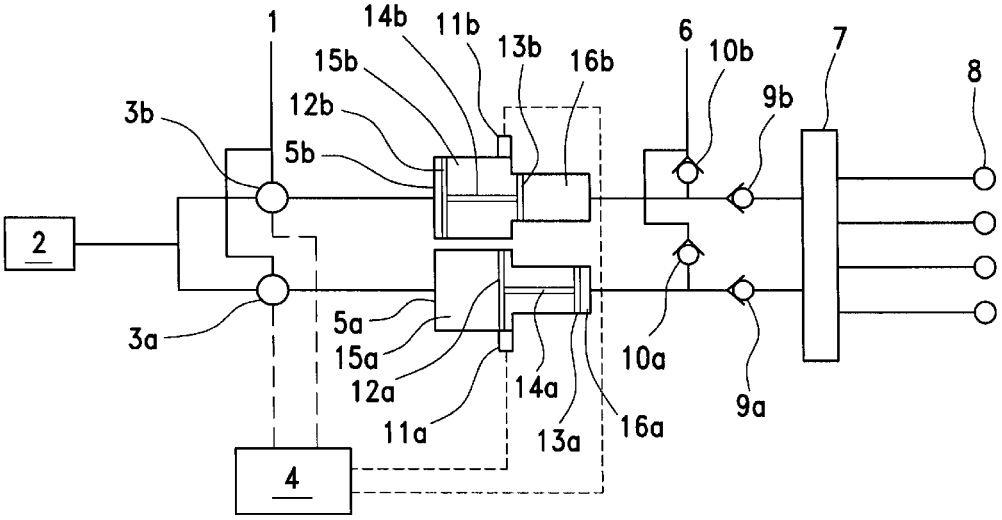
FIG. 1 is a schematic diagram of a first preferred embodiment of the common rail fuel injection system of the present invention.

A first preferred embodiment of the present invention is shown in FIG. 1. As shown in FIG. 1, hydraulic fluid is supplied by line 2 to intensifier circuits a and b through the hydraulic control valves 3*a*, 3*b*, respectively. The control valves 3*a*, 3*b* are switched on or off by an electric controller 4.

When control valve 3*a* is "ON", hydraulic fluid from line 2 supplies hydraulic fluid to operating chamber 15*a* of the intensifier 5*a*. Fluid pressure in chamber 15*a* applies a force to piston 12*a* which is mechanically connected to piston 13*a* by intensifier piston rod 14*a*. Fuel in the intensifier high pressure chamber 16*a* is pressurized by piston 13*a* and flows to check valves 10*a* and 9*a*. Check valve 10*a* closes flow to line 6 and check valve 9*a* opens flow to high pressure common rail 7 which supplies fuel to fuel injectors 8. The intensifier circuit a may be considered to include intensifier 5*a* and the lines and valves between it and common rail 7.

When control valve 3*a* is "OFF", hydraulic fluid in the intensifier 5*a* is connected to hydraulic fluid return line 1 ("drain"). The pressure in the intensifier operating chamber 15*a* drops, reducing the force applied to pistons 12*a* and 13*a* and dropping the pressure in high pressure chamber 16*a*. High pressure fuel is checked at check valve 9*a* and fuel flows from line 6 through check valve 10*a* when pressure in high pressure chamber 16*a* drops below fuel supply pressure in line 6. The fuel supply pressure in chamber 16*a* applies force to piston 13*a* and moves rod 14*a* and piston 12*a* to the retracted position, filling chamber 16*a* with fuel.

Intensifier circuit b functions identically to intensifier circuit a. thus, when the 3 way valve 3*b* is switched "ON", the valve 3*b* connects the regulated pressure hydraulic fluid supply 2 through intensifier circuit b to the low pressure side 15*b* of the intensifier 5*b*. The hydraulic fluid applies a force to the large diameter intensifier piston 12*b* which is transmitted by a shaft 14*b* to a smaller diameter high pressure piston or ram 13*b*. The high pressure piston or ram 13*b* pressurizes the fuel in the high pressure chamber 16*b* to a pressure higher that that of the supplied hydraulic fluid of supply source 2. The fuel exits the chamber 16*b* through a check valve 9*b* and into the common rail 7, while closing the fuel supply check valve 10*b*. Thus, intensifier circuit b includes intensifier 5*b* and the lines and valves between it and the common rail 7.

When the 3-way valve is switched "OFF", the 3-way valve connects the intensifier hydraulic chamber 15*b* to the low pressure hydraulic return 1 ("drain"). The pressure in the intensifier hydraulic side drops and allows the intensifier piston 12*b* to retract. The pressure in the intensifier high pressure fuel chamber 16*b* drops, closing the common rail check valve 9*b* and opening the fuel supply check valve 10*b*. The supply fuel pressure applies a force to the intensifier high pressure piston or ram 13*b* and moves the piston 13*b* to the retracted position and fills the intensifier high pressure chamber 16*b* with fuel.

The control valves 3*a*, 3*b* are controlled by an electric controller 4. The controller 4 may operate in either of two strategies: (1) open loop time-based mode or (2) closed loop mode using proximity sensor feedback. In each strategy the two three-way control valves 3*a*, 3*b* operate in two modes: (1) supplying the common rail with high pressure fuel in one switch position and (2) refilling the intensifier from the low pressure fuel supply 2 in a second switch position. The control valves 3*a*, 3*b* are switched in such a way that the common rail 7 has an uninterrupted supply of high pressure fuel.

In an open loop time-based mode, the controller 4 switches the control valves 3*a*, 3*b* on a preset constant time basis, regardless of intensifier piston position. This method is the simplest and requires no feedback sensors for sending signals to the controller 4.

In a closed loop mode using proximity sensor feedback, the controller 4 uses the feedback signal from a proximity sensor 11*a*, 11*b* mounted on the intensifier body. The controller 4 switches the control valves 3*a*, 3*b* when the proximity sensor 11*a*, 11*b* detects end of an intensifier piston stroke. This method only cycles the control valves as needed, eliminating unnecessary system cycling during low fuel output modes. This method can also measure fuel consumption based on intensifier cycle time and known intensifier displacement.

Figure 2:
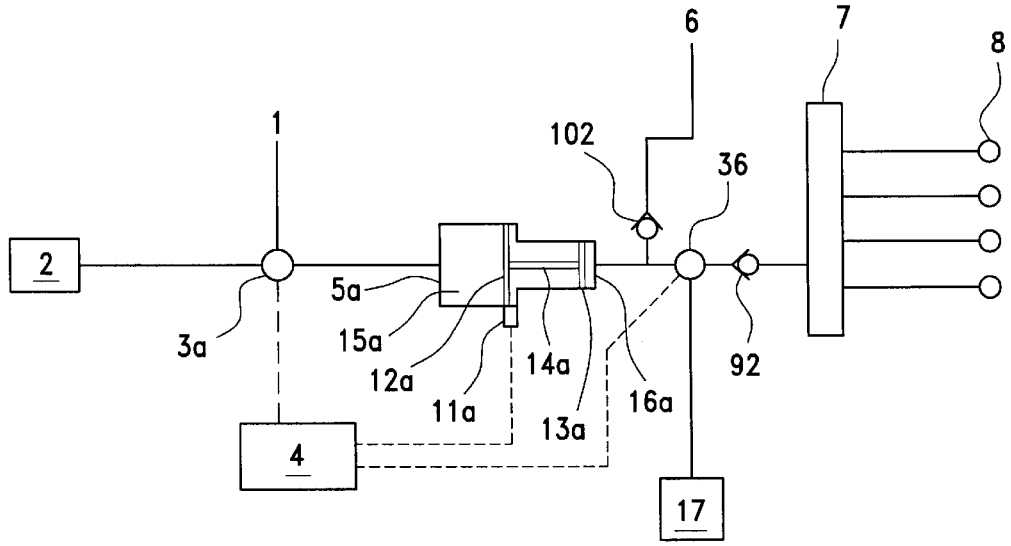
FIG. 2 is a schematic diagram of a second preferred embodiment of the common rail fuel injection system of the present invention.

A second preferred embodiment of the fuel injection system of the present invention is illustrated in FIG. 2. In FIG. 2, the fuel pressure intensifying circuit a is similar to that of FIG. 1 except that a control valve 3*c* is inserted therein between the intensifier 5*a* and check valve 9*a*. Instead of the intensifier circuit b of the embodiment of FIG. 1, the preferred embodiment shown in FIG. 2 has an intensifier circuit c which includes an accumulator 17. In the embodiment of FIG. 2 the accumulator 17 in combination with the control valve 3*c* and the line connecting same constitute another fuel pressure intensifying circuit, i.e., circuit c. In this embodiment, fuel at the intensified pressure may be supplied from intensifier 5*a* either directly to the rail 7, through control valve 36 and check valve 9*a*, or to the accumulator 17. Likewise, the control valve 3*c*, under control of controller 4, can feed fuel at the intensified pressure from either the intensifier 5*a* or the accumulator 17.

A number of modifications of the embodiment depicted in FIG. 2 are feasible. For example, the control valve 3*c* can perform the function of check valve 9*a*, thus allowing the circuit to be simplified by omission of check valve 9*a*. Further, the embodiment of FIG. 1 could be modified by substituting an accumulator for intensifier 5*a* and routing fuel discharge from fuel chamber 16*b* to the accumulator through control valve 3*a*.

Of course, the embodiment of FIG. 1 can use more than two intensifiers and intensifier circuits to supply fuel to the common rail. Likewise, the embodiment of FIG. 2 can use more than one intensifier. Multiple intensifiers increase the system flow rate and decrease the frequency of intensifier cycling.

Further, while the preferred embodiments have been described above in the context of a system with three-way valves which are electrically controlled, such electrical control can be replaced with a mechanical system that would mechanically link the valves to an intensifier shaft. In such a modification, the three-way valves would actuate in relation to the intensifier shaft position by means of a mechanical linkage system.

It is also contemplated that the three-way valves could be controlled (switched) based on feedback from a linear displacement transducer. The linear displacement transducer would sense the position of the intensifier shaft and use this feedback to control the switching of the three-way valves.

Further, the outlet check valves 9*a*, 10*a*, 9*b*, 10*b*, etc., could be replaced with control valves to direct flow of fluid from the intensifiers to the common rail.

It is further contemplated that multiple intensifiers can be attached together in series wherein the outlet pressure from one intensifier would be the inlet pressure to a second intensifier within a single intensifier circuit. In other words, the multiple intensifiers in series would increase fuel pressure in multiple stages to a final outlet pressure.

As noted above, the working fluid may be either hydraulic oil, i.e., a hydraulic system, or air, i.e., a pneumatic system.

The hydraulically intensified high pressure fuel system for common rail application of the present invention offers the following advantages over the conventional diesel piston pump:

1. The intensifier of the present invention uses fewer moving parts and is less expensive;
2. The intensifier of the present invention does not require high precision piston plunger assemblies and is less expensive for this reason also;
3. The intensifier of the present invention is isolated from the engine and can mounted anywhere on the vehicle chassis whereas the conventional diesel piston pump must be mounted on the engine; and
4. The intensifier of the present invention can supply fuel to a common rail fuel injection system using a low lubricity fuel whereas the conventional diesel piston pump is designed to be used with a high lubricity diesel fuel.

The hydraulically intensified high pressure fuel system for common rail application of the present invention offers the following advantages over the conventional intensified unit injector:

1. The common rail intensifier unit of the present invention has fewer moving parts than the conventional intensified pressure unit injector;
2. As a common rail injector, the system of the present invention does not require individual hydraulic lines to each injector as is required with the intensified unit injector, thus reducing the number of hydraulic lines and potential leakage points; and
3. The intensified common rail system of the present invention can be used with current production common rail injectors.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed:

1. A common rail intensifier, fuel injection system for a multi-cylinder internal combustion engine with multiple cylinders, comprising:

a plurality of fuel injectors respectively associated with the multiple cylinders;

a common rail for supply of fuel at an intensified pressure to said plurality of fuel injectors;

a fuel supply containing fuel at a low pressure relative to the intensified pressure within the common rail;

at least two fuel pressure intensifying circuits for alternately supplying fuel at the intensified pressure to said common rail;

an operating fluid source;

a first fuel pressure intensifier in one of said pressure intensifying circuits and comprising an operating chamber of a first diameter for receiving and discharging the operating fluid, a fuel chamber of a second diameter, smaller than said first diameter, for receiving fuel at the low pressure from said fuel supply and discharging fuel at the intensified pressure to said common rail;

a first control valve for, in a first position, connecting said operating fluid source with said operating chamber of said fuel pressure intensifier and, in a second position, connecting said operating chamber of said fuel pressure intensifier with a drain; and control means for switching said control valve between the first and second positions and for switching supply of fuel at the intensified pressure to said common rail between said fuel pressure intensifying circuits.

2. The common rail intensifier fuel injection system of claim 1 wherein another of said fuel pressure intensifying circuits comprises:

an accumulator for storing fuel at the intensified pressure; and a second control valve, switched between at least two positions by said control means, said second control valve connecting said accumulator with said common rail in one of its positions and connecting said accumulator with said first fuel pressure intensifier in another of its positions.

3. The common rail intensifier, fuel injection system of claim 1 wherein another of said fuel pressure intensifying circuits comprises:

a second fuel pressure intensifier comprising a second operating chamber of a first diameter for receiving and discharging the operating fluid, a second fuel chamber of a second diameter, smaller than the diameter of said operating chamber; and a second control valve switchable between at least two positions by said control means, said second control valve connecting said operating chamber of said second fuel pressure intensifier with said operating fluid sources in one of its positions and with a drain in another of its positions.

4. The common rail intensifier, fuel injection system of claim 3, further comprising:

a one-way check valve interposed between said fuel supply and one of said fuel pressure intensifying circuits; and a one-way check valve interposed between said one fuel pressure intensifying circuit and said common rail.

5. The common rail intensifier, fuel injection system of claim 1, further comprising:

a one-way check valve interposed between said fuel supply and one of said fuel pressure intensifying circuits; and a one-way check valve interposed between said one fuel pressure intensifying circuit and said common rail.

* * * * *